United States Patent [19]

Haustein

[11] 4,143,731

[45] Mar. 13, 1979

[54] EXHAUST FLOW DIRECTIONAL DEVICE

[75] Inventor: Norman E. Haustein, Auburn Heights, Mich.

[73] Assignee: General Motors Corporation, Detroit, Mich.

[21] Appl. No.: 863,318

[22] Filed: Dec. 22, 1977

[51] Int. Cl.[2] ..... F01N 7/20

[52] U.S. Cl. ..... 180/64 A; 180/1 FV

[58] Field of Search ..... 296/1 S, 91, 15; 180/64 A, 1 FV, 69.1; 181/38, 43, 51; 98/59, 83, 84; 110/84

[56] References Cited

U.S. PATENT DOCUMENTS

| | | | |
|---|---|---|---|
| 572,415 | 12/1896 | Dunmore | 98/84 |
| 1,738,279 | 12/1929 | Barries | 98/84 X |
| 2,582,905 | 1/1952 | Harmon | 98/83 |
| 2,630,748 | 3/1953 | Brockelsby | 98/83 X |
| 3,788,072 | 1/1974 | Burger | 98/59 X |
| 3,952,823 | 4/1976 | Hinderks | 180/64 A |
| 4,018,472 | 4/1977 | Mason | 296/1 S |

*Primary Examiner*—Joseph F. Peters, Jr.
*Assistant Examiner*—Gene A. Church
*Attorney, Agent, or Firm*—Charles E. Leahy

[57] ABSTRACT

An airfoil is mounted on the exhaust pipe of a tractor trailer vehicle generally forward the exhaust pipe opening so as to be upstream of the exhaust pipe in the airflow deflected by a drag reducer mounted on the tractor roof forward the exhaust pipe. The airfoil splits the deflected airflow around the exhaust pipe. The airfoil has a pervious portion located generally below the exhaust pipe opening to allow airflow therethrough to prevent a low pressure buildup in the area generally below the exhaust pipe opening. The airfoil also has an airflow impervious portion located generally above the exhaust pipe opening to create a low pressure behind the impervious portion and generally above the exhaust opening to thereby draw the exhaust flow upwardly into the deflected airflow.

2 Claims, 2 Drawing Figures

EXHAUST FLOW DIRECTIONAL DEVICE

The invention relates to an exhaust flow directional device for attachment on the exhaust pipe of a tractor.

It is known to provide an aerodynamic drag reducer atop the tractor of a tractor trailer vehicle in order to reduce fuel consumption. One such drag reducer is disclosed in U.S. Pat. Nos. 3,972,556, issued Aug. 3, 1976 and 4,018,472, issued Apr. 19, 1977, entitled "Tractor Trailer Aerodynamic Drag Reducer" by William T. Mason, Jr., and assigned to the assignee of this invention.

Drag reducers according to the Mason patents and other commercially available devices extend above the roof of the tractor cab forwardly the air space conventionally occupied by the exhaust pipe and the engine air intake stack. Accordingly it is advantageous to have the exhaust pipe extend substantially above the upper end of the drag reducer in order to inject the exhaust flow into the deflected airstream so that the exhaust flow is not dispersed in the stagnated air behind the drag reducer and recirculated into the engine air intake. However, it has been found that the additive height of the drag reducer and the exhaust pipe extending thereabove can in some instances interfere with overhead obstructions such as door openings in buildings where the tractors are serviced. As a result of this interference, some users of drag reducer equipped tractors are unable to have the exhaust pipe extend the necessary substantial distance above the drag reducer and may experience recirculation of exhaust into the engine intake stack.

The object of this invention is to provide an exhaust flow directional device which is attached to the end of the exhaust stack and imparts a trajectory and velocity to the exhaust flow which insures injection into the airflow deflected by the drag reducer.

According to the invention, an airfoil is mounted on the exhaust pipe adjacent the exhaust pipe opening and generally forward the exhaust pipe so as to be upstream of the exhaust pipe relative the airflow deflected by the drag reducer. The airfoil splits the deflected airflow around the exhaust pipe. The airfoil has a pervious portion located generally below the exhaust pipe opening to allow airflow therethrough to prevent a low pressure buildup in the area generally below the exhaust pipe opening. The airfoil also has an airflow impervious portion located generally above the exhaust pipe opening to create a low pressure behind the impervious portion and generally above the exhaust opening to thereby draw the exhaust flow upwardly into the deflected airflow.

Figure 1:
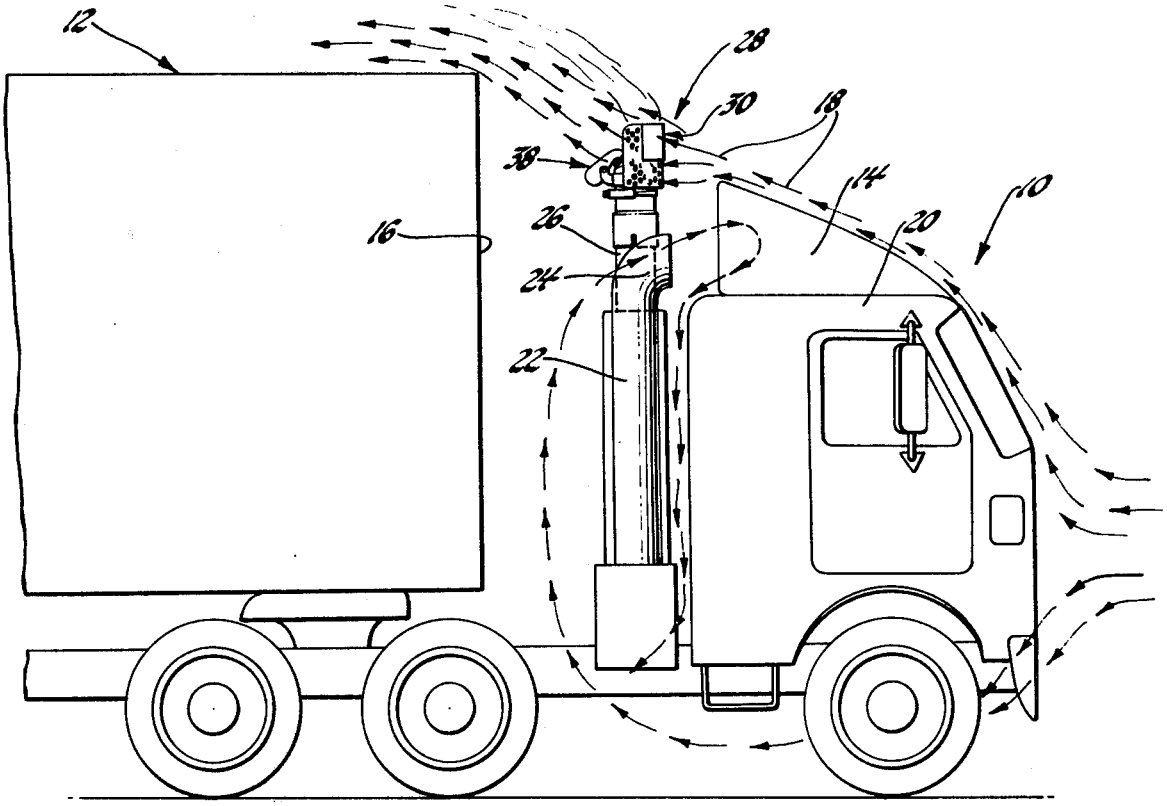
Figure 2:
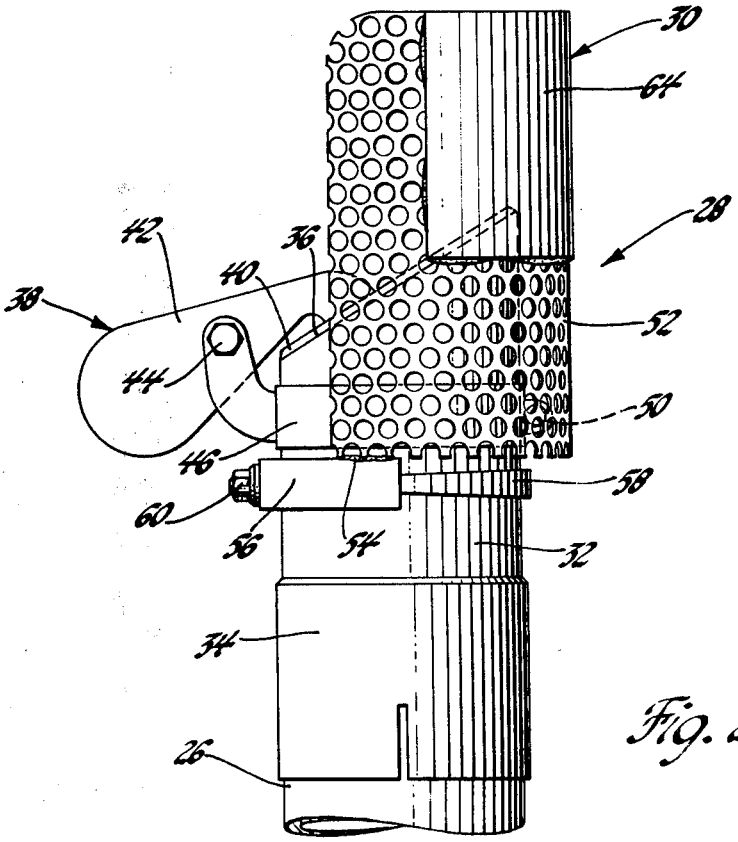

These and other objects, features and advantages of the invention will become apparent upon consideration of the specification and the appended drawings in which:

FIG. 1 is a side elevation view of a tractor trailer having a drag reducer and the exhaust flow directional device of this invention; and FIG. 2 is an enlarged fragmentary view of FIG. 1 showing the construction of the exhaust flow directional device.

Referring to FIG. 1 of the drawing, it is seen that a tractor trailer includes a tractor 10 connected to a trailer 12. The tractor has a roof mounted aerodynamic drag reducer 14 mounted on the cam thereof for deflecting the oncoming airflow over the bluff frontal wall 16 of trailer 12 as indicated by the arrows 18. An engine air intake system associated with the tractor includes an air intake stack 22 positioned just rearwardly the cab 20 and having an air inlet opening or air precleaner and intake assembly 24 at its upper end. An engine exhaust system associated with the tractor 10 includes an exhaust pipe 26 which rises adjacent the air intake stack 22 and has an outlet opening at its end.

The exhaust flow directional device generally indicated at 28 is best seen in FIG. 2. Referring to FIG. 2, a tubular extension 32 has a flared lower end 34 which is engaged by interference fit over the upper end of the exhaust pipe 26. The upper end of the tubular extension 32 is beveled to provide an angularly inclined outlet opening 36. A rain cover assembly generally indicated at 38 includes a closure 40 attached to a mounting lever 42 which is in turn pivotally mounted relative the tubular extension 32 by pivot bolt 44 attached to a mounting ring 46 which encircles the tubular extension 32 and is attached thereto by a bolt and nut assembly 50. The rain cover assembly 38 assumes the normal closed position of FIG. 2 when there is no exhaust airflow and is opened by the exhaust flow when the tractor engine is running.

The exhaust flow directional device 28 has an airfoil 30 formed by a perforated plate 52 which is bent to a semicircular configuration as viewed from above to surround the forward portion of the tubular extension 32 at a spacing of about one inch therefrom. The perforated plate 52 is welded at 54 to a saddle bracket 56 having an associated U-bolt 58 and a pair of nut and bolt assemblies 60 which cooperate to attach the perforated plate 52 to the tubular extension 32. The airfoil 30 also includes an air impervious solid plate 64 which overlies the upper portion of the perforated plate 52, and is welded thereto. The lower edge of the solid plate 64 is disposed at generally the same elevation as the outlet opening 36 and somewhat below the highest elevation of the tubular extension 32.

In operation the oncoming airstream deflected by the drag reducer 14 as indicated by arrows 18 is split by the air-foil 30 of flow directional device 28 so that the airflow passes to the sides thereof and then closes behind and continues over the roof of the trailer 12. The perforations of the perforated plate 52 allow passage therethrough of a sufficient volume of airflow to prevent the buildup of a low pressure area in the region generally below the outlet opening 36. The air impervious solid plate 64 splits the total volume of airflow and induces a low pressure region therebehind in the region generally above the outlet opening 36 to thereby draw the exhaust flow upwardly from the outlet opening 36 and inject the exhaust flow into the deflected airstream with a trajectory and velocity sufficient to prevent circulation to a lower elevation adjacent the inlet 24 of the engine intake stack 22.

Referring to FIG. 1, it is seen that the exhaust flow directional device 28 is mounted somewhat behind the trailing edge of the drag reducer 14 with the bottom of the perforated plate 52 thereof disposed at the same elevation as the trailing edge of the drag reducer. I have found that adequate performance is obtained by a flow directional device wherein airfoil 30 has an overall height of about nine inches and an impervious solid plate 64 of about five inches in height.

Thus, it is seen that the invention provides an exhaust flow directional device which injects an exhaust flow into the airflow deflected from an aerodynamic drag reducer to prevent recirculation of the exhaust gasses into the engine intake system.

The embodiments of the invention in which an exclusive property or privilege is claimed are defined as follows:

1. In a tractor having a roof mounted air deflector and an engine exhaust pipe located behind the air deflector and having an opening discharging engine exhaust into the deflected airflow, an exhaust flow directional device comprising: a semicylindrical airfoil, means mounting the airfoil on the exhaust pipe adjacent the exhaust pipe opening and in the deflected airflow upstream of the exhaust pipe opening to split the deflected airflow around the exhaust pipe, said airfoil having a semicylindrical pervious portion located generally below the exhaust pipe opening allowing airflow therethrough to prevent low pressure behind the pervious portion of the airfoil and a semicylindrical impervious portion located generally above the exhaust pipe opening to create a low pressure behind the impervious portion of the airfoil and above the exhaust opening to thereby draw the exhaust flow upwardly into the deflected airflow.

2. In a tractor having a roof mounted air deflector and an engine exhaust pipe located behind the air deflector and having an opening discharging engine exhaust into the deflected airflow, an exhaust flow directional device comprising: an airfoil having a semicylindrical wall, means mounting the airfoil on the exhaust pipe adjacent the exhaust pipe opening with the semicylindrical wall thereof spaced from the exhaust pipe and in the deflected airflow upstream of the exhaust pipe opening to split the deflected airflow around the exhaust pipe, said semi-cylindrical wall having a plurality of perforations in a region thereof generally below the exhaust pipe opening allowing airflow therethrough to prevent low pressure behind the perforated portion of the semicylindrical wall and a solid impervious portion located generally above the exhaust pipe opening to create a low pressure behind the solid impervious portion of the airfoil and above the exhaust opening to thereby draw the exhaust flow upwardly into the deflected airflow.

* * * * *